US012486735B2

(12) United States Patent
Campos et al.

(10) Patent No.: US 12,486,735 B2
(45) Date of Patent: Dec. 2, 2025

(54) DOWNHOLE TOOL, BOTTOMHOLE ASSEMBLY, AND DRILLING METHOD USING SAME

(71) Applicant: SAUDI ARABIAN OIL COMPANY, Dhahran (SA)

(72) Inventors: Fernando Rodriguez Campos, Dhahran (SA); Ahmed Elsayed Khalaf, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 112 days.

(21) Appl. No.: 18/320,092

(22) Filed: May 18, 2023

(65) Prior Publication Data

US 2024/0384624 A1 Nov. 21, 2024

(51) Int. Cl.

| | |
|---|---|
| ***E21B 34/10*** | (2006.01) |
| ***E21B 7/28*** | (2006.01) |
| ***E21B 10/26*** | (2006.01) |
| ***E21B 43/12*** | (2006.01) |

(52) U.S. Cl.

CPC ..... *E21B 34/10* (2013.01); *E21B 7/28* (2013.01); *E21B 10/26* (2013.01); *E21B 43/12* (2013.01)

(58) Field of Classification Search

CPC ... E21B 7/28; E21B 7/30; E21B 10/26; E21B 10/60; E21B 10/61; E21B 37/00; E21B 37/02; E21B 34/10; E21B 43/12; E21B 21/00; E21B 21/14; E21B 31/03; E21B 31/00; E21B 47/09

See application file for complete search history.

(56) References Cited

U.S. PATENT DOCUMENTS

| | | | | |
|---|---|---|---|---|
| 2,785,875 | A | 3/1957 | Hayes | |
| 4,909,325 | A | 3/1990 | Hopmann | |
| 7,823,645 | B2 | 11/2010 | Henriksen et al. | |
| 10,577,869 | B2 | 3/2020 | Cao et al. | |
| 11,180,959 | B2 | 11/2021 | Jathmi | |
| 2003/0056811 | A1* | 3/2003 | Walker | E21B 37/00 134/22.12 |
| 2006/0086507 | A1* | 4/2006 | Surjaatmadja | E21B 37/00 166/265 |
| 2007/0056745 | A1* | 3/2007 | Contant | E21B 34/066 166/382 |
| 2009/0145661 | A1* | 6/2009 | Jeffryes | E21B 47/09 175/46 |
| 2013/0054146 | A1* | 2/2013 | Rasmus | E21B 47/06 702/9 |
| 2014/0124195 | A1* | 5/2014 | Tahoun | E21B 34/12 166/250.01 |
| 2014/0262211 | A1* | 9/2014 | Xu | E21B 34/10 166/179 |

(Continued)

*Primary Examiner* — George S Gray

(74) *Attorney, Agent, or Firm* — Osha Bergman Watanabe & Burton LLP

(57) ABSTRACT

A downhole tool includes: a tubular body having a central bore; a plurality of first ports that extend through a sidewall of the tubular body; a plurality of reaming blades that extend from an outer surface of the sidewall; and a flow control node configured to control a switching of each of the plurality of first ports between an open state and a closed state based on a command from a surface control unit. The plurality of first ports are configured to eject rearward jets of fluid in the open state.

19 Claims, 5 Drawing Sheets

(56) References Cited

U.S. PATENT DOCUMENTS

| | | | | |
|---|---|---|---|---|
| 2014/0291023 | A1* | 10/2014 | Edbury | E21B 21/08<br>345/440.2 |
| 2015/0068804 | A1 | 3/2015 | Keshavan et al. | |
| 2016/0053604 | A1* | 2/2016 | Abbassian | E21B 44/00<br>702/6 |

* cited by examiner

DOWNHOLE TOOL, BOTTOMHOLE ASSEMBLY, AND DRILLING METHOD USING SAME

BACKGROUND

Wellbore cleaning is essential to all kinds of drilling operations, including the drilling of production and exploration wells. Non-Productive Time (NPT) related to stuck pipe and hole cleaning issues and the cost of operation can be reduced by optimizing the number of clean-out trips.

Despite numerous advancements of tools and equipment in drilling and wellbore cleaning operations, there are still unpredictable incidents happening, which lead to an increase in rig downtime due a poor hole cleaning (especially on horizontal wells), severe downtime of the rig due to stuck pipe, or failures of the drilling tools. All of these happen due to the solids and debris accumulation on the lower side wall of the deviated wellbore. The debris and cuttings that remain in the wellbore will damage the well formation and slow down the process of the drilling operation.

Such incidents, which include high tension on the drill string, often require replacement of drilling tools due to wear and tear. High temperature is formed due to high frictional force, which leads to high risk of failing to achieve the optimum level of drilling. Accordingly, a clean wellbore is essential to ensuring a smooth drilling process and to keeping advantageous drilling production of the well life.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to to a downhole tool. The downhole tool includes: a tubular body having a central bore; a plurality of first ports that extend through a sidewall of the tubular body; a plurality of reaming blades that extend from an outer surface of the sidewall; and a flow control node configured to control a switching of each of the plurality of first ports between an open state and a closed state based on a command from a surface control unit. The plurality of first ports are configured to eject rearward jets of fluid in the open state.

In another aspect, embodiments disclosed herein relate to a bottomhole assembly (BHA). The BHA includes a drill bit; a measurement-while-drilling (MWD) tool uphole of the drill bit; and a downhole tool uphole of the MWD tool. The downhole tool includes: a tubular body having a central bore; a plurality of first ports that extend through a sidewall of the tubular body; a plurality of reaming blades that extend from an outer surface of the sidewall; and a flow control node configured to control a switching of each of the plurality of first ports between an open state and a closed state based on a command from a surface control unit. The plurality of first ports are configured to eject rearward jets of fluid in the open state.

In yet another aspect, embodiments disclosed herein relate to a drilling method. The drilling method includes connecting a downhole tool on a bottomhole assembly (BHA); running the BHA down a wellbore and drilling until a target depth; and pulling the BHA out of the wellbore. Pulling the BHA out of the wellbore may include ejecting rearward jets of fluid through ports of the downhole tool and back reaming the wellbore by reaming blades of the downhole tool.

Other aspects and advantages of the claimed subject matter will be apparent from the following description and the appended claims.

DETAILED DESCRIPTION

In the following detailed description of embodiments of the disclosure, numerous specific details are set forth to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before." "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the present disclosure relate to a downhole tool, a bottomhole assembly ("BHA") having the downhole tool connected thereon, and a drilling method using the same. In one or more embodiments, the downhole tool includes ports through which rearward and/or forward jets of fluid are ejected into an annulus of a wellbore (especially that of a deviated or horizontal well). In one or more embodiments, the downhole tool includes a flow control node configured to control a switching of each of the ports between an open state and a closed state based on a command from a surface control unit. In one or more embodiments, the downhole tool includes reaming blades configured to back ream the wellbore during pulling out of the BHA. During the pulling out of the BHA, the rearward and/or forward jets of fluid help weaken and/or soften any cuttings bed that may have accumulated on a lower side of a deviated or horizontal section of the wellbore. Combining the weakening and/or softening effect with the back reaming by the reaming blades, a clean wellbore can be ensured when the BHA (or drill string) is pulled out of the wellbore.

Figure 1:
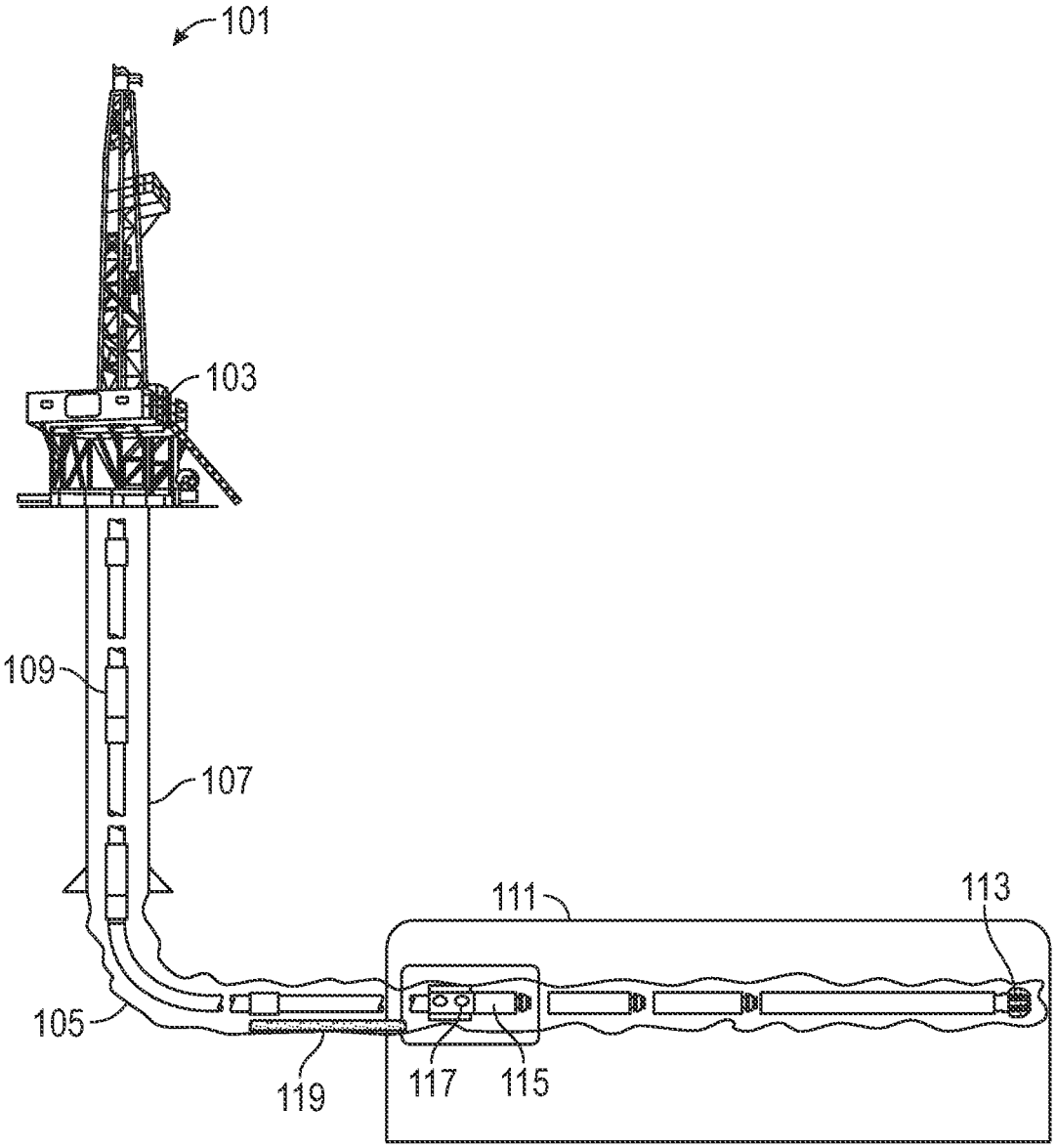
FIG. 1 is a schematic view of an example drilling operation.

FIG. 1 is a schematic view of an example drilling operation. Embodiments of the present disclosure may be suitable for use in any drilling operations, for example, the drilling of oil well, gas well, geothermal well, etc. In the embodiment shown, an oil well is being drilled. As typical in onshore oil wells, FIG. 1 shows a rig 101 beneath which a drilling operation is performed into subterranean formations to reach an oil reservoir, for example. FIG. 1 also shows a wellbore 105 that has been drilled to a certain depth. In this example, the wellbore 105 includes a vertical section and a horizontal section. That is, a deviated or horizontal well is being drilled. In this example, the vertical section is already cased with casing 107. The horizontal section is an open borehole being drilled.

The length (measured depth) of the wellbore 105 is extended by the operation of a drill string 109 that includes a BHA 111 at the downhole end of the drill string 109. The BHA 111 includes, at the downhole end thereof, a drill bit 113. The drill bit 113 may be driven by, for example, a mud motor on the BHA 111 that draws hydraulic horsepower from a drilling fluid circulated through the BHA 111. By the rotation of the drill bit 113, the wellbore 105 is extended. During this process, the drill bit 113 continuously breaks the rock formation and cuttings of the broken rocks are formed. As is well known in the art, the circulation of the drilling fluid through an annulus between the drill string 109 and the wall of the wellbore 105 may carry the cuttings to the surface. However, the cuttings may still accumulate on a lower side of the horizontal section of the wellbore 105 due to gravity. Thus, one or more cuttings beds 119 may be formed. Such cuttings beds produce a high risk of pipe sticking, hole pack-off, high drag and torque, a low rate of penetration (ROP), and high annular circulating pressure.

In accordance with one or more embodiments, a downhole tool 117 is provided on the BHA 111 to help remove the cuttings beds 119, especially during the pulling of the drill string 109 (hence the BHA 111) out of the wellbore 105. In one or more embodiments, the downhole tool 117 is connected on the BHA at a location uphole of a measurement-while-drilling (MWD) tool 115 of the BHA. In the embodiment shown, the downhole tool 117 is directly connected to the MWD tool 115 downhole of the downhole tool 117. In other embodiments, other tools or equipment may be connected between the downhole tool 117 and the MWD tool 115.

Figure 2:
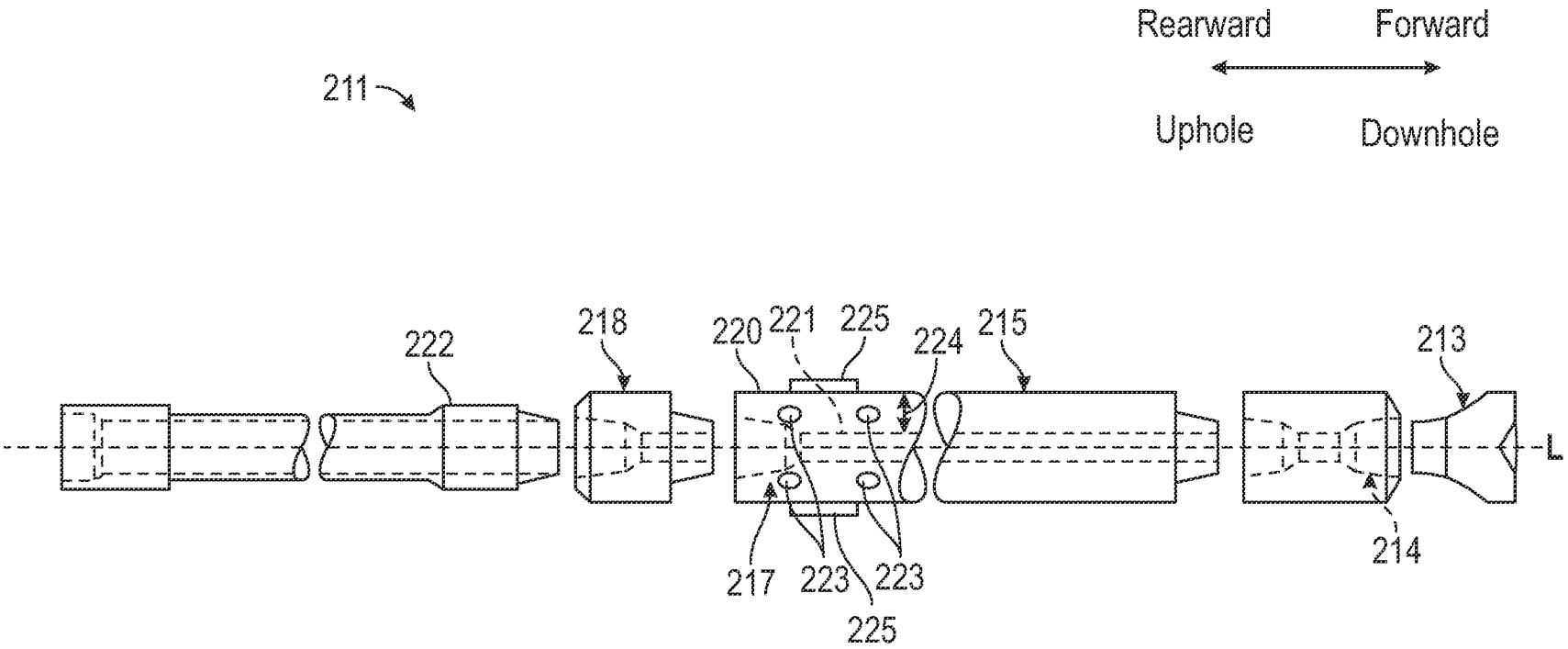
FIG. 2 is a schematic view of an example bottomhole assembly (BHA).

FIG. 2 is a schematic view of an example BHA 211. At an end of the BHA 211 is a drill bit 213. In this figure, a direction along a longitudinal axis L of the BHA in which the drill bit 213 advances during drilling is defined as a "forward" or "downhole" direction. The opposite direction along the longitudinal axis L of the BHA is defined as a "rearward" or "uphole" direction. In this example, instead of a mud motor, the drill bit 213 is connected to a rotary steerable system (RSS) 214. The RSS 214, in turn, is connected to a MWD 215 uphole of the RSS 214. In the embodiment shown, the RSS 214 and the MWD 215 are directly connected to each other. A downhole tool 217 in accordance with one or more embodiments is provided on the BHA 211 at a location uphole of the MWD 215. The downhole tool 217 may or may not be directly connected to the MWD 215. In this example, the downhole tool 217 is connected, at the uphole end thereof, to a drill pipe 222 via a crossover 218.

In FIG. 2, an overall configuration of the downhole tool 217 is also shown. The downhole tool 217 has a tubular body 220. The longitudinal axis L of the BHA is also the longitudinal axis of the tubular body 220. Along the longitudinal axis L, the tubular body 220 has a central bore 221. A fluid (for example, drilling fluid) may be pumped through the central bore 221 in the downhole direction during a drilling operation. The central bore 221 is in fluid communication with central fluid passages of the other parts of the BHA 211 and a drill string to which the BHA 211 may be connected.

The central bore 221 is defined by a sidewall 224 of the tubular body 220. A plurality of ports 223 that extend through the sidewall 224 are provided. The ports 223 are configured to be able to be in fluid communication with the central bore 221 and divert a flow of the fluid circulating in the central bore 221 to an outside of the downhole tool 217. The diverted flows of the fluid may be ejected through the ports 223 as fluid jets that may exert a substantial force on any constrictions around the downhole tool 217. The number of the ports 223 is not particularly limited. More details of the configuration and functions of the ports 223 are described below with reference to FIG. 3.

Continuing with FIG. 2, the downhole tool 217 also includes a plurality of reaming blades 225 on an outer surface of the sidewall 224 of the tubular body 220. The reaming blades 225 may also be referred to as "arms" or "blocks." Any known types of blades can used for reaming and back reaming purposes. The number of the reaming blades 225 is not particularly limited. In some embodiments, the downhole tool 217 includes three reaming blades 225. The plurality of reaming blades 225 may be evenly distributed around a circumference of the outer surface of the sidewall 224. In one or more embodiments, the reaming blades 225 may include an extended state in which the blades 225 fully extend from the outer surface of the sidewall 224 (the state shown in FIG. 2) and a retracted state in which the blades 225 are retracted into the sidewall 224. In such embodiments, the reaming blades 225 are only in the extended state, for example, when reaming or back reaming operation is needed.

Figure 3:
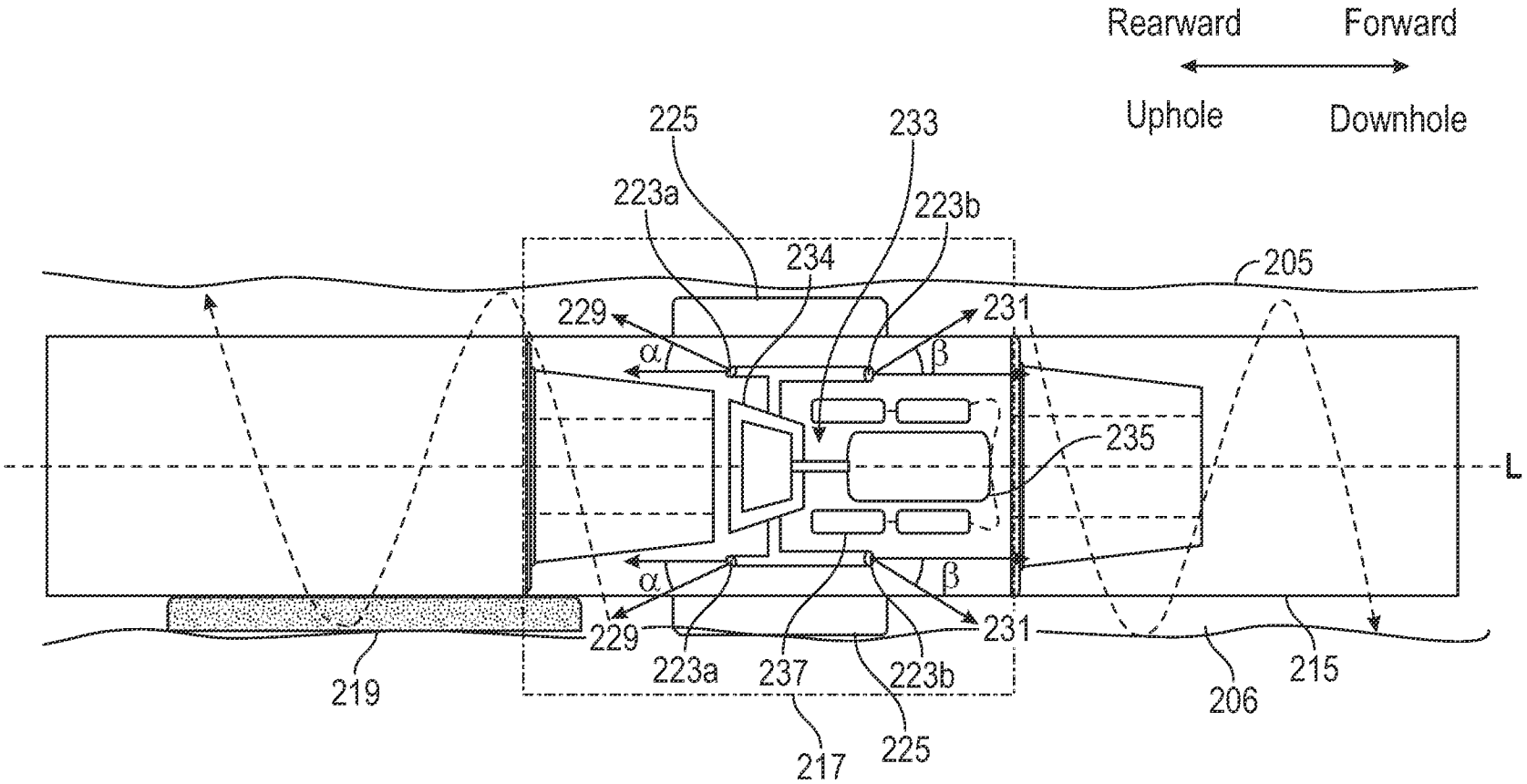
FIG. 3 is a schematic view of an example downhole tool connected on the BHA shown in FIG. 2.

Turning to FIG. 3, the plurality of ports 223 may include a plurality of first ports **223*a* and a plurality of second ports 223*b*. Each of the first ports 223*a* and second ports 223*b* may be switched between an open state (including partially open state) and a closed state. This may be achieved by, for example, the operation of a valve via an actuator, or by any other known mechanisms in the art. The number of the first ports 223*a* and the number of the second ports 223*b* are not particularly limited. The first ports 223*a* and the second ports 223*b***, respectively, may be evenly distributed in a circumferential direction.

The plurality of first ports **223*a* are configured to eject rearward jets 229 of fluid in the open state. In other words, the first ports 223*a* in the open state divert, at least partially, the flow of fluid from the central bore 221 into an annulus 206 formed between the wellbore 205 and the drill string to which the BHA 211 is connected. The jets 229 are ejected in a first direction. In one or more embodiments, the first direction and the central axis L of the tubular body 220 form a first angle $\alpha$ that is less than 90 degrees. When the jets 229 are ejected while the BHA is being rotated, the jets 229 create a swirling movement of fluid in the annulus 206**.

The plurality of second ports **223*b* are configured to eject forward jets 231 of fluid in the open state. In other words, the second ports 223*b* in the open state divert, at least partially, the flow of fluid from the central bore 221 into the annulus 206. The jets 231 are ejected in a second direction. In one or more embodiments, the second direction and the central axis L of the tubular body 220 form a second angle $\beta$ that is less than 90 degrees. When the jets 231 are ejected while the BHA is being rotated, the jets 231 create a swirling movement of fluid in the annulus 206**.

The plurality of second ports **223*b* are provided on the downhole tool 217 downhole of the plurality of first ports 223*a*. However, the positions of the ports 223 (including the first ports 223***a* and the second ports 223*b*) along the central axis L are not particularly limited relative to the reaming blades 225. In some embodiments, at least the first ports 223*a* are positioned so as to eject fluid jets 229 that impacts an accumulated cuttings bed 219 prior to the reaming blades 225.

In any event, the fluid jets 229 and/or 231 weaken and/or soften the cuttings bed 219 during, for example, the pulling of the BHA 211 (or drill string) out of the wellbore 205. The weakened and/or softened cuttings bed 219 is then easily broken by the reaming blades and carried uphole by the increased circulation in the annulus 206.

In FIG. 3, the downhole tool 217 also includes a flow control node 233 configured to control the switching of each of the first ports 223*a* and the second ports 223*b* between the open state and the closed state. For example, the flow control node 233 may control the actuator for the valve associated with each of the ports 223. The controlling of the switching of the ports 223 by the flow control node 233 is based on a command from a surface control unit 103 (FIG. 1) that may be installed on a rig floor of the rig 101.

In one or more embodiments, the flow control node 233 and the surface control unit 103 may communicate with each other by a telemetric method. For example, the command from the surface control unit 103 to the flow control node 233 to open or close the ports 223 may be in a form of coded pressure pulse generated via the circulated fluid by the operation of a valve on the surface. In the embodiment shown, the flow control node 233 includes a transducer 234 configured to convert the coded pressure pulse into a coded electrical signal. The transducer 234 may be, for example, a hydrophone. The flow control node 233 further includes electronics 235 configured to generate a decoded electrical signal by decoding the coded electrical signal and control the switching of each of the ports 223 by the decoded electrical signal.

In one or more embodiments, the downhole tool 217 includes a battery or a set of batteries 237 that supply electrical power for the operation of the downhole tool 217, including for example the transducer 234, the electronics 235, and the actuators (not shown) associated with the ports 223.

Figure 4:
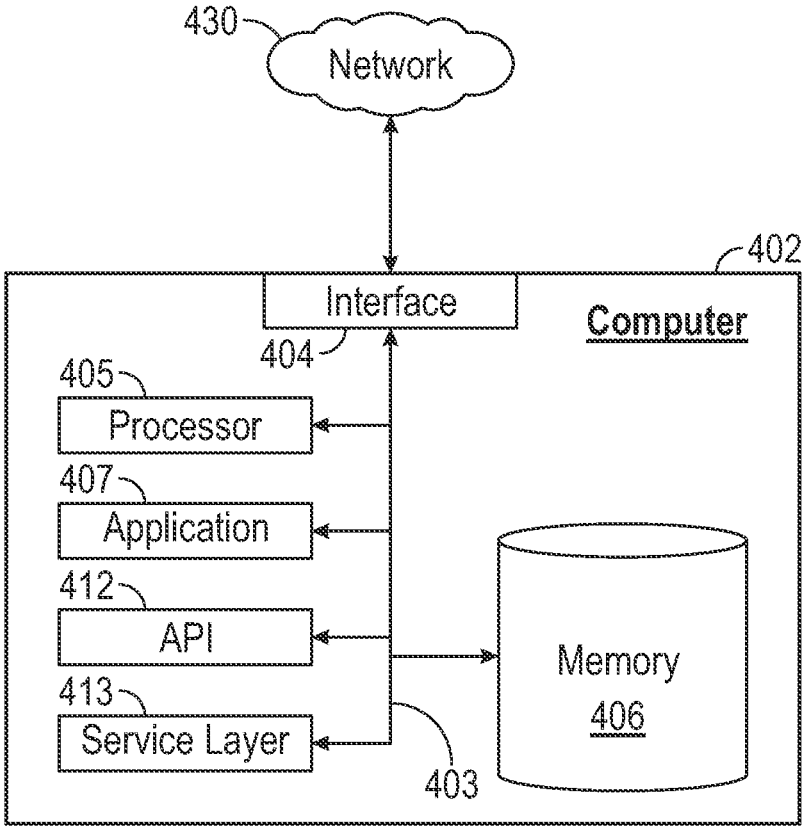
FIG. 4 shows an example computing system.

Embodiments of the surface control unit 103 may be implemented on a computer system. FIG. 4 is a block diagram of a computer system 402 used to provide computational functionalities associated with described algorithms, methods, functions, processes, flows, and procedures as described in the instant disclosure, according to an implementation. The illustrated computer 402 is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 402 may include a computer that includes an input device, such as a keypad, keyboard, touch screen, or other device that can accept user information, and an output device that conveys information associated with the operation of the computer 402, including digital data, visual, or audio information (or a combination of information), or a GUI.

The computer 402 can serve in a role as a client, network component, a server, a database or other persistency, or any other component (or a combination of roles) of a computer system for performing the subject matter described in the instant disclosure. The illustrated computer 402 is communicably coupled with a network 430. In some implementations, one or more components of the computer 402 may be configured to operate within environments, including cloud-computing-based, local, global, or other environment (or a combination of environments).

At a high level, the computer 402 is an electronic computing device operable to receive, transmit, process, store, or manage data and information associated with the described subject matter. According to some implementations, the computer 402 may also include or be communicably coupled with an application server, e-mail server, web server, caching server, streaming data server, business intelligence (BI) server, or other server (or a combination of servers).

The computer 402 can receive requests over network 430 from a client application (for example, executing on another computer 402) and responding to the received requests by processing the said requests in an appropriate software application. In addition, requests may also be sent to the computer 402 from internal users (for example, from a command console or by other appropriate access method), external or third-parties, other automated applications, as well as any other appropriate entities, individuals, systems, or computers.

Each of the components of the computer 402 can communicate using a system bus 403. In some implementations, any or all of the components of the computer 402, both hardware or software (or a combination of hardware and software), may interface with each other or the interface 404 (or a combination of both) over the system bus 403 using an application programming interface (API) 412 or a service layer 413 (or a combination of the API 412 and service layer 413. The API 412 may include specifications for routines, data structures, and object classes. The API 412 may be either computer-language independent or dependent and refer to a complete interface, a single function, or even a set of APIs. The service layer 413 provides software services to the computer 402 or other components (whether or not illustrated) that are communicably coupled to the computer 402. The functionality of the computer 402 may be accessible for all service consumers using this service layer. Software services, such as those provided by the service layer 413, provide reusable, defined business functionalities through a defined interface. For example, the interface may be software written in JAVA, C++, or other suitable language providing data in extensible markup language (XML) format or other suitable format. While illustrated as an integrated component of the computer 402, alternative implementations may illustrate the API 412 or the service layer 413 as stand-alone components in relation to other components of the computer 402 or other components (whether or not illustrated) that are communicably coupled to the computer 402. Moreover, any or all parts of the API 412 or the service layer 413 may be implemented as child or sub-modules of another software module, enterprise application, or hardware module without departing from the scope of this disclosure.

The computer 402 includes an interface 404. Although illustrated as a single interface 404 in FIG. 4, two or more interfaces 404 may be used according to particular needs, desires, or particular implementations of the computer 402. The interface 404 is used by the computer 402 for communicating with other systems in a distributed environment that are connected to the network 430. Generally, the interface 404 includes logic encoded in software or hardware (or a combination of software and hardware) and operable to communicate with the network 430. More specifically, the interface 404 may include software supporting one or more communication protocols associated with communications such that the network 430 or interface's hardware is operable to communicate physical signals within and outside of the illustrated computer 402.

The computer 402 includes at least one computer processor 405. Although illustrated as a single computer processor 405 in FIG. 4, two or more processors may be used according to particular needs, desires, or particular implementations of the computer 402. Generally, the computer processor 405 executes instructions and manipulates data to perform the operations of the computer 402 and any algorithms, methods, functions, processes, flows, and procedures as described in the instant disclosure.

The computer 402 also includes a memory 406 that holds data for the computer 402 or other components (or a combination of both) that can be connected to the network 430. For example, memory 406 can be a database storing data consistent with this disclosure. Although illustrated as a single memory 406 in FIG. 4, two or more memories may be used according to particular needs, desires, or particular implementations of the computer 402 and the described functionality. While memory 406 is illustrated as an integral component of the computer 402, in alternative implementations, memory 406 can be external to the computer 402.

The application 407 is an algorithmic software engine providing functionality according to particular needs, desires, or particular implementations of the computer 402, particularly with respect to functionality described in this disclosure. For example, application 407 can serve as one or more components, modules, applications, etc. Further, although illustrated as a single application 407, the application 407 may be implemented as multiple applications 407 on the computer 402. In addition, although illustrated as integral to the computer 402, in alternative implementations, the application 407 can be external to the computer 402.

There may be any number of computers 402 associated with, or external to, a computer system containing computer 402, each computer 402 communicating over network 430. Further, the term "client," "user," and other appropriate terminology may be used interchangeably as appropriate without departing from the scope of this disclosure. Moreover, this disclosure contemplates that many users may use one computer 402, or that one user may use multiple computers 402.

In some embodiments, the computer 402 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (Saas), mobile "backend" as a service (MBaaS), serverless computing, artificial intelligence (AI) as a service (AIaaS), and/or function as a service (FaaS).

Figure 5:
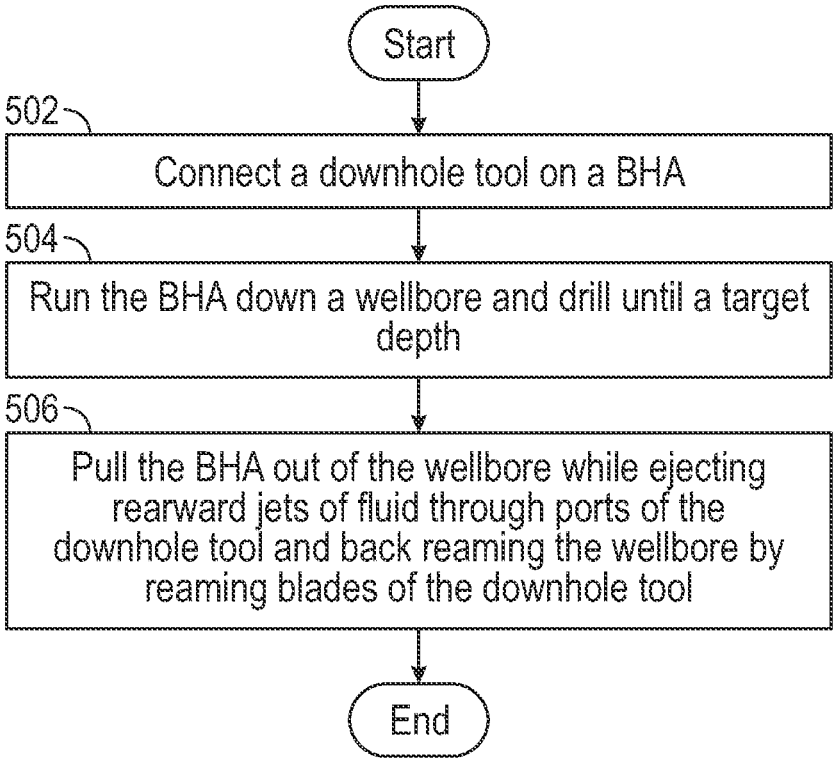
FIG. 5 is a flowchart of an example drilling method.

FIG. 5 is flowchart of an example drilling method. In Step 502, a downhole tool according to one or more embodiments (for example, the downhole tool 217 as shown in FIGS. 2 and 3) is connected on a BHA. In Step 504, the BHA, connected on a drill string, is run down a wellbore to drill the wellbore until a target depth. In Step 506, the BHA (or the drill string) is pulled out of the wellbore while ejecting rearward jets of fluid through ports of the downhole tool and back reaming the wellbore by reaming blades of the downhole tool.

In one or more embodiments, the wellbore includes a deviated or horizontal section. The rearward fluid jets weaken and/or soften cuttings beds that have accumulated on a lower side wall of the deviated or horizontal section of the wellbore. In one or more embodiments, prior to pulling the BHA out of the wellbore, the wellbore is circulated with a fluid until one or more surface shakers are clean. In one or more embodiments, prior to pulling the BHA out of the wellbore, back reaming parameters are established. In these embodiments, the BHA is pulled out of the wellbore based on the established parameters. In one or more embodiments, pulling the BHA out of the wellbore is performed while rotating the BHA. By rotating the BHA, the rearward fluid jets create a swirling movement of the fluid in the wellbore annulus. By rotating the BHA, the reaming blades also perform back reaming to remove the weakened and/or softened cuttings beds.

Figure 6:
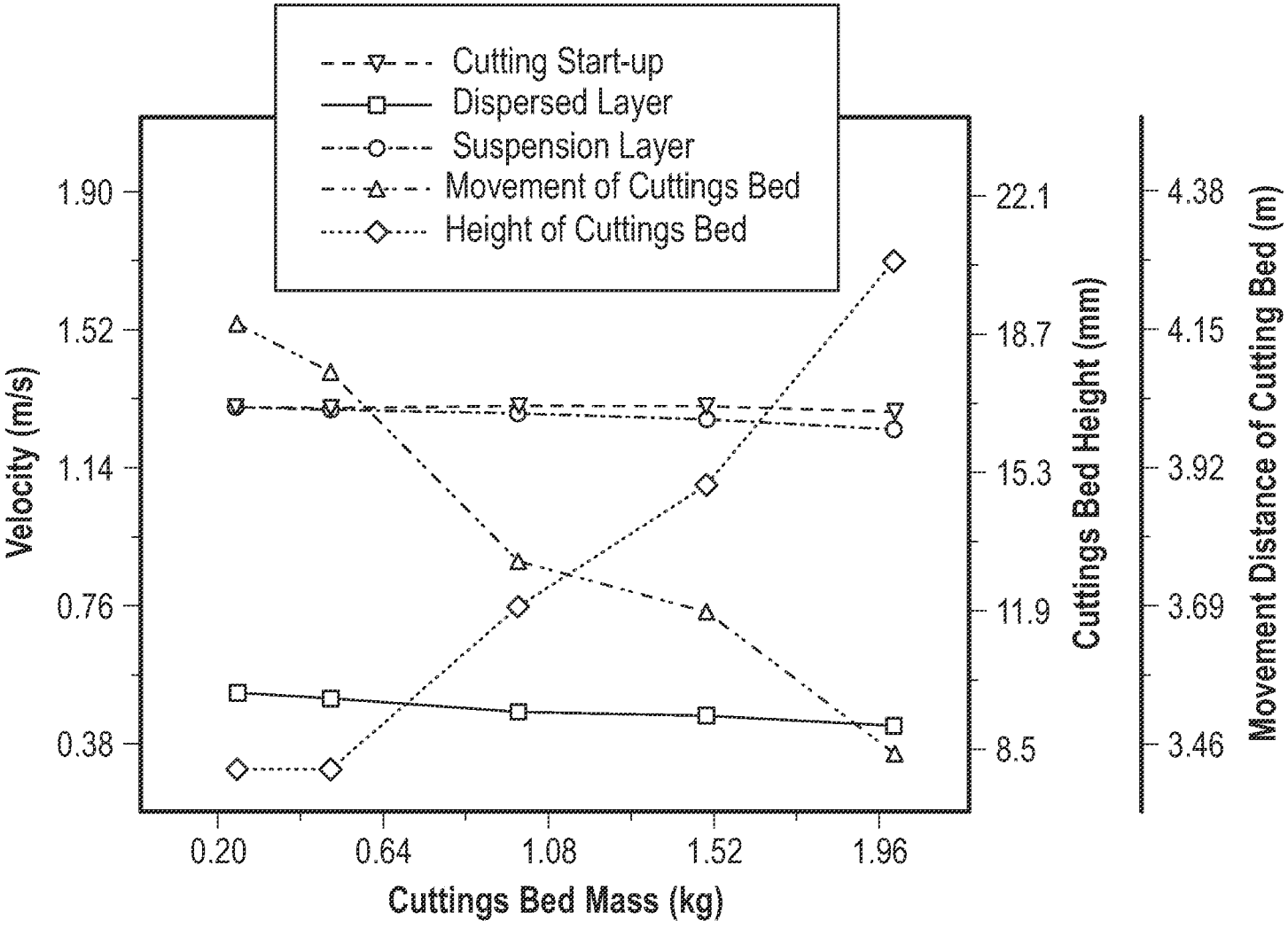
FIG. 6 is an example graph of wellbore clean-out parameters.

FIG. 6 shows an example graph of wellbore clean-out parameters. These clean-out parameters are back reaming parameters established prior to pulling the BHA out of the wellbore. As shown in this example, the parameters include cuttings bed height, cuttings bed mass, annular velocity, and movement distance of cuttings bed. The back reaming parameters are not limited to the those shown in FIG. 6 and may include, for example, rotation speed of the drill string, pull-out-hole time, etc.

Next, a process of establishing the back reaming parameters will be described. After the BHA is run down the wellbore to drill until the target depth (Step 504), a command is sent from the surface control unit (e.g., surface control unit 103) to the downhole tool (e.g., downhole tool 117 or 217) to open the ports (e.g., any or all of the ports 223) to a required cross area. The ports may be fully open or partially open. In some embodiments, the downhole tool may send a signal (for example, by way of mud pulses) uphole to the surface control unit to confirm that the ports have been successfully opened. By using the MWD on the BHA, information for establishing the back reaming parameters is sent uphole to the surface control unit. At the surface control unit, any known hydraulic software may be used to establish the parameters. In one or more embodiments, a three-layer numerical simulation model of cuttings transport in horizontal and deviated wells may be built based on the established parameters and used for clean-out analysis in real time. As an example, the three-layer numerical simulation model may estimate cuttings bed height, cuttings bed mass, annular velocity, rotation speed of drill string, and pull-out-hole time that are needed to remove all the cuttings at an acceptable level. For example, the acceptable level may be a condition in which the wellbore is cleaned at higher requirements than normally required of a BHA without coupling a downhole tool according to one or more embodiments of the present disclosure.

Based on the clean-out or back reaming parameters thus established, the BHA may be pulled out of the wellbore while ejecting rearward and/or forward jets of fluid through the ports of the downhole tool and back reaming the wellbore by the reaming blades of the downhole tool. In one or more embodiments, the BHA may not be pulled out of the wellbore. Instead, the BHA may be pulled uphole until reaching the casing shoe. When the BHA reaches the casing shoe, a command may be sent from the surface control unit to the downhole tool to close the ports to stop the rearward and/or forward jets. In these embodiments, normal operation may then be resumed to continue, for example, completion of the wellbore.

While the above description is given in the context of using the downhole tool according to one or more embodiments in a wellbore clean-out operation, the downhole tool according to one or more embodiments may also be used in other applications including, but not limited to, pumping acid stimulation fluids and spotting high concentrate lost circulation materials (LCM), bridging materials, and high concentrate acid for stuck pipe. All those fluids will be diverted at the downhole tool without reaching or affecting sensitive section of the BHA (e.g., mud motor, MWD, and/or RSS) that is downhole of the downhole tool.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A downhole tool comprising:

a tubular body having a central bore;

a plurality of first ports and a plurality of second ports that extend through a sidewall of the tubular body;

a plurality of reaming blades that extend from an outer surface of the sidewall, wherein the plurality of reaming blades is retractable; and a flow control node configured to control a switching of each of the plurality of first ports and each of the plurality of second ports between an open state and a closed state based on a command from a surface control unit by individually controlling a separate valve for each of the plurality of first ports and a separate valve for each of the plurality of second ports, wherein the plurality of first ports is configured to eject rearward jets of fluid in the open state, and wherein the plurality of second ports is configured to eject forward jets of fluid in the open state.

2. The downhole tool of claim 1, wherein each of the plurality of first ports is configured to eject the rearward jets of fluid in a first direction, and wherein the first direction and a central axis of the tubular body form a first angle less than 90 degrees.

3. The downhole tool of claim 1, wherein each of the plurality of second ports is configured to eject the forward jets of fluid in a second direction, and wherein the second direction and a central axis of the tubular body form a second angle less than 90 degrees.

4. The downhole tool of claim 1, wherein the command from the surface control unit is in a form of coded pressure pulses.

5. The downhole tool of claim 4, wherein the flow control node comprises:

a transducer configured to convert the coded pressure pulses into a coded electrical signal; and electronics configured to generate a decoded electrical signal by decoding the coded electrical signal and control the switching of each of the plurality of first ports by the decoded electrical signal.

6. The downhole tool of claim 1, further comprising a battery that supplies electrical power for operation of the downhole tool.

7. The downhole tool of claim 1, wherein the downhole tool is configured to be connected at a location on a bottomhole assembly (BHA).

8. The downhole tool of claim 7, wherein the location on the bottomhole assembly is uphole of a measurement-while-drilling tool on the BHA.

9. A bottomhole assembly (BHA) comprising:

a drill bit;

a measurement-while-drilling (MWD) tool uphole of the drill bit; and a downhole tool uphole of the MWD tool, wherein the downhole tool comprises:

a tubular body having a central bore;

a plurality of first ports and a plurality of second ports that extend through a sidewall of the tubular body;

a plurality of reaming blades that extend from an outer surface of the sidewall wherein the plurality of reaming blades is retractable; and a flow control node configured to control a switching of each of the plurality of first ports and each of the plurality of second ports between an open state and a closed state based on a command from a surface control unit by individually controlling a separate valve for each of the plurality of first ports and a separate valve for each of the plurality of second ports, and wherein the plurality of first ports is configured to eject rearward jets of fluid in the open state, and wherein the plurality of second ports is configured to eject forward jets of fluid in the open state.

10. The BHA of claim 9, wherein each of the plurality of first ports is configured to eject the rearward jets of fluid in a first direction, and wherein the first direction and a central axis of the tubular body form a first angle less than 90 degrees.

11. The BHA of claim 9, wherein each of the plurality of second ports is configured to eject the forward jets of fluid in a second direction, and wherein the second direction and a central axis of the tubular body form a second angle less than 90 degrees.

12. The BHA of claim 9, wherein the command from the surface control unit is in a form of coded pressure pulses.

13. The BHA of claim 12, wherein the flow control node comprises:

a transducer configured to convert the coded pressure pulses into a coded electrical signal; and electronics configured to generate a decoded electrical signal by decoding the coded electrical signal and control the switching of each of the plurality of first ports by the decoded electrical signal.

14. The BHA of claim 9, wherein the downhole tool further comprises a battery that supplies electrical power for operation of the downhole tool.

15. A drilling method comprising:

connecting a downhole tool on a bottomhole assembly (BHA), the downhole tool comprising:

a tubular body having a central bore, a plurality of first ports and a plurality of second ports that extend through a sidewall of the tubular body, a plurality of reaming blades that extend from an outer surface of the sidewall, wherein the plurality of reaming blades is retractable, and a flow control node configured to control a switching of each of the plurality of first ports and each of the plurality of second ports between an open state and a closed state based on a command from a surface control unit by individually controlling a separate valve for each of the plurality of first ports and a separate valve for each of the plurality of second ports, wherein the plurality of first ports is configured to eject rearward jets of fluid in the open state, and wherein the plurality of second ports is configured to eject forward jets of fluid in the open state;

running the downhole tool and the BHA down a wellbore and drilling until a target depth; and pulling the downhole tool and the BHA out of the wellbore comprising:

ejecting the rearward jets of fluid through the plurality of first ports and back reaming the wellbore using the plurality of reaming blades.

16. The drilling method of claim 15, further comprising:

circulating the wellbore until a surface shaker is clean prior to pulling the BHA out of the wellbore.

17. The drilling method of claim 15, further comprising:

establishing back reaming parameters prior to pulling the BHA out of the wellbore.

18. The drilling method of claim 15, wherein pulling the BHA out of the wellbore is performed while rotating the BHA.

19. The drilling method of claim 15, further comprising ejecting the forward jets of fluid through the plurality of second ports.

* * * * *